US010488773B2

(12) United States Patent
Koide et al.

(10) Patent No.: US 10,488,773 B2
(45) Date of Patent: Nov. 26, 2019

(54) IMAGE FORMING APPARATUS COMPRISING A SUPPLYING DEVICE INCLUDING A STORAGE AND A TRANSPORT UNIT

(71) Applicant: FUJI XEROX CO., LTD., Tokyo (JP)

(72) Inventors: Takafumi Koide, Kanagawa (JP); Masataka Kuribayashi, Kanagawa (JP); Yusuke Fukuda, Kanagawa (JP); Katsuyuki Kitajima, Kanagawa (JP); Teppei Yawada, Kanagawa (JP); Shota Oshima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/125,854

(22) Filed: Sep. 10, 2018

(65) Prior Publication Data

US 2019/0294066 A1 Sep. 26, 2019

(30) Foreign Application Priority Data

Mar. 22, 2018 (JP) ..... 2018-053766

(51) Int. Cl.
*G03G 15/08* (2006.01)
*G03G 9/087* (2006.01)
*G03G 9/08* (2006.01)

(52) U.S. Cl.
CPC ..... *G03G 9/08755* (2013.01); *G03G 9/0821* (2013.01); *G03G 15/0822* (2013.01)

(58) Field of Classification Search
CPC ..... G03G 9/0821; G03G 9/08755; G03G 15/0822; G03G 15/0865; G03G 15/0874; G03G 15/0879

(Continued)

(56) References Cited

U.S. PATENT DOCUMENTS 7,620,349 B2 11/2009 Katsuyama
7,925,190 B2 * 4/2011 Matsumoto et al. ..... G03G 15/0874 399/258

FOREIGN PATENT DOCUMENTS

| | | |
|---|---|---|
| JP | 2000-056504 A | 2/2000 |
| JP | 2006-258927 A | 9/2006 |
| JP | 2018-010226 A | 1/2018 |

* cited by examiner

*Primary Examiner* — William J Royer
(74) *Attorney, Agent, or Firm* — Sughrue Mion, PLLC

(57) ABSTRACT

An image forming apparatus includes an image holding member, a developing device, and a supplying device including a storage unit and a transport unit, wherein the storage unit stores toner and includes a bag having a flexible material, the transport unit uses suction pressure to transport the toner from the storage unit and supplies to the developing device, the toner contains an amorphous polyester resin, toner particles of the toner have a weight average molecular weight Mw and a number average molecular weight Mn, the weight average molecular weight Mw is in a range of 25,000 to 60,000, a ratio Mw/Mn is in a range the range of 5 to 10, a ratio (P2/P1) of a peak height of an absorption peak of the toner particles at a wavenumber of 820 $cm^{-1}$ (P2) to a peak height of the absorption peak at a wavenumber of 720 $cm^{-1}$ (P1) is 0.4 or less, and a ratio (P3/P1) of a peak height of the absorption peak of the toner particles at a wavenumber of 1500 $cm^{-1}$ (P3) to the peak height of the absorption peak at the wavenumber of 720 $cm^{-1}$ (P1) is 0.6 or less.

11 Claims, 4 Drawing Sheets

(58) Field of Classification Search
USPC ..... 399/252, 258; 430/114
See application file for complete search history.

IMAGE FORMING APPARATUS COMPRISING A SUPPLYING DEVICE INCLUDING A STORAGE AND A TRANSPORT UNIT

CROSS-REFERENCE TO RELATED APPLICATIONS

This application is based on and claims priority under 35 USC 119 from Japanese Patent Application No. 2018-053766 filed Mar. 22, 2018.

BACKGROUND

(i) Technical Field

The present disclosure relates to an image forming apparatus.

(ii) Related Art

Known electrophotographic image forming apparatuses, such as copying machines and printers, include a developing device that contains a developer and a supplying machine that supplies toner or the developer to the developing device.

Japanese Laid Open Patent Application Publication No. 2018-10226 discloses a developer transporting device including a transport path through which a developer supplied downward from a supply port is transported in the direction intersecting this downward direction, a developer transporting unit that transports the developer in the transport path, a developer detector that detects the developer at the position at which the developer dropped from the supply port is transported through the developer transporting unit.

Japanese Laid Open Patent Application Publication No. 2006-258927 discloses an agent container and an image forming apparatus including the agent container; the agent container contains toner or a carrier used in an electrophotographic process or a developer containing the toner and the carrier and includes a flexible container body in which such an agent is contained, a bottom plate that removably supports the container body, and a shutter that covers a toner discharge port formed in the container body.

In a known toner, a polyester resin is used as a binder resin, a tetrahydrofuran-soluble component is analyzed by gel permeation chromatography to determine a weight average molecular weight Mw and a number average molecular weight Mn, the Mw is from 10,000 to 60,000, a ratio Mw/Mn is from 5 to 10, a ratio (P2/P1) of a peak height of an absorption peak at a wavenumber of 820 $cm^{-1}$ (P2) in an absorption spectrum obtained by infrared absorption spectroscopy to the peak height of the absorption peak at a wavenumber of 720 $cm^{-1}$ (P1) is 0.4 or less, and a ratio (P3/P1) of the peak height of the absorption peak at a wavenumber of 1500 $cm^{-1}$ (P3) to the peak height of the absorption peak at a wavenumber of 720 $cm^{-1}$ (P1) is 0.6 or less. Such a toner is good in fixability, while it has a high moisture absorption property and is likely to coagulate. Hence, in a supplying device of a related art in which toner is transported with a unit that mechanically contacts with the toner, the toner coagulates and accumulates inside the supplying device because of the pressure applied to the toner during the transport thereof, and the toner is discharged in greatly varied amount, which is problematic. In particular, this problem readily occurs in a high temperature and high humidity environment in which the coagulation is easily caused.

SUMMARY

Aspects of non-limiting embodiments of the present disclosure relate to an image forming apparatus including a supplying device that enables a reduction in a variation in an amount of toner supplied to a developing device as compared with a case the case of using a supplying device that transports toner with a unit that mechanically contacts with the toner even when toner having the following characteristics is used: a polyester resin is used as a binder resin, a tetrahydrofuran-soluble component is analyzed by gel permeation chromatography to determine a weight average molecular weight Mw and a number average molecular weight Mn, the Mw is from 10,000 to 60,000, a ratio Mw/Mn is from 5 to 10, a ratio (P2/P1) of a peak height the absorption peak at a wavenumber of 820 $cm^{-1}$ (P2) in an absorption spectrum obtained by infrared absorption spectroscopy to the peak height of the absorption peak at a wavenumber of 720 $cm^{-1}$ (P1) is 0.4 or less, and a ratio (P3/P1) of the peak height of the absorption peak at a wavenumber of 1500 $cm^{-1}$ (P3) to the peak height of the absorption peak at a wavenumber of 720 $cm^{-1}$ (P1) is 0.6 or less.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image holding member, a developing device that contains an electrostatic charge image developer and that develops an electrostatic charge image on the surface of the image holding member with the electrostatic charge image developer to form a toner image, and a supplying device including a storage unit and a transport unit, wherein the storage unit stores toner and includes a bag having a flexible material; the transport unit uses suction pressure to transport the toner from the storage unit and supplies the toner to the developing device; the electrostatic charge image developer contains the toner; the toner contains an amorphous polyester resin as a binder resin; and the toner has a weight average molecular weight Mw and a number average molecular weight Mn; the weight average molecular weight Mw is in a range of 25,000 to 60,000; a ratio Mw/Mn is in a range of 5 to 10; a ratio (P2/P1) of a peak height of an absorption peak of toner particles at a wavenumber of 820 $cm^{-1}$ (P2) to the peak height of the absorption peak at a wavenumber of 720 $cm^{-1}$ (P1) is 0.4 or less; and a ratio (P3/P1) of the peak height of the absorption peak of the toner particles at a wavenumber of 1500 $cm^{-1}$ (P3) to the peak height of the absorption peak at a wavenumber of 720 $cm^{-1}$ (P1) is 0.6 or less.

BRIEF DESCRIPTION OF THE DRAWINGS

Exemplary embodiment of the present disclosure will be described in detail based on the following figures, wherein.

DETAILED DESCRIPTION

Examples of the exemplary embodiment of the present disclosure will now be described with reference to the drawings. The following descriptions and Examples are given merely as examples of the exemplary embodiment, and the scope of the disclosure is not limited thereto.

Image Forming Apparatus

Figure 1:
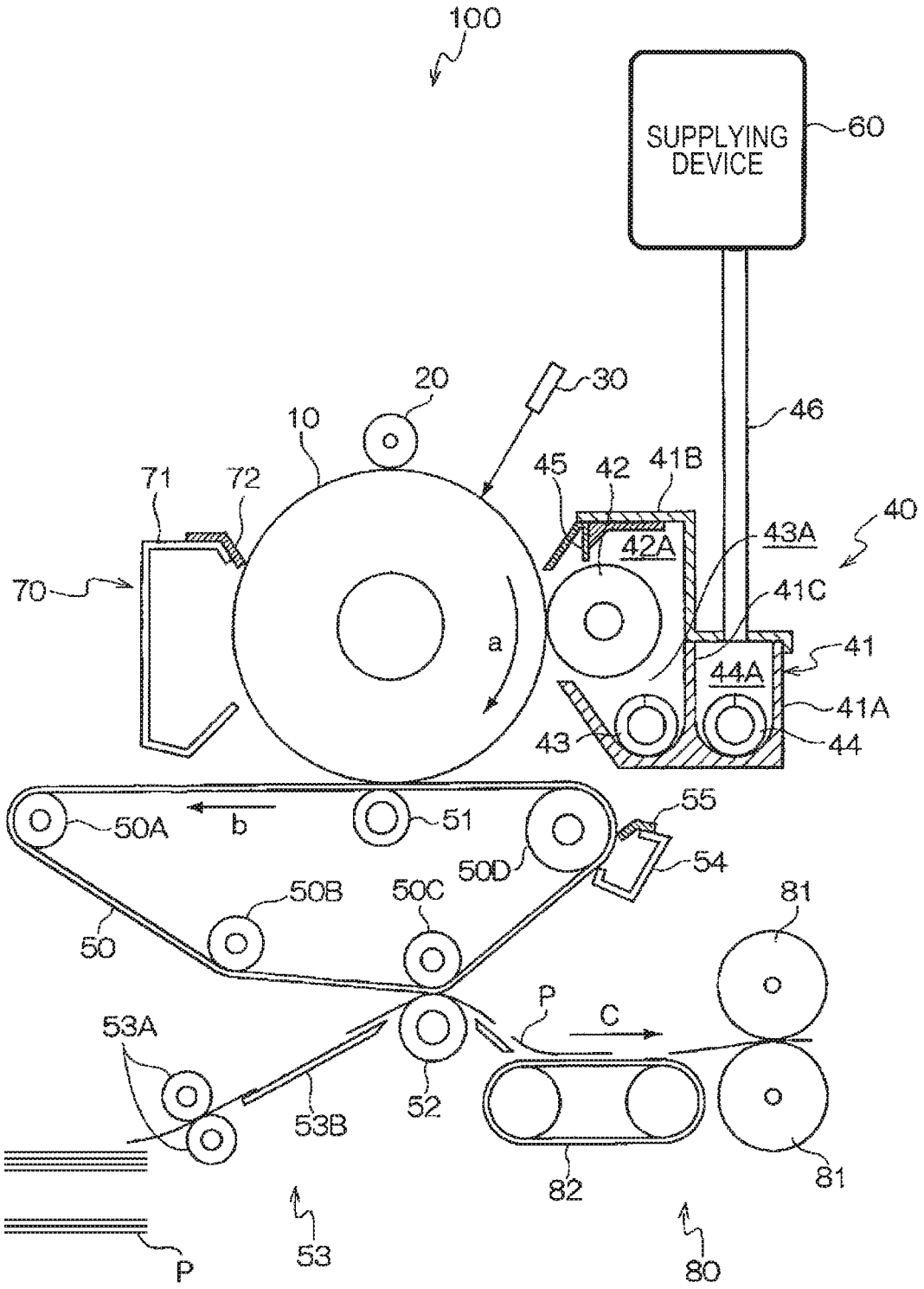
FIG. 1 schematically illustrates an example of the structure of an image forming apparatus according to an exemplary embodiment.

FIG. 1 schematically illustrates the structure of an image forming apparatus 100 according to the exemplary embodiment. With reference to FIG. 1, the image forming apparatus 100 according to the exemplary embodiment, for example, includes a latent image holding member 10 which rotates clockwise as indicated by the arrow a, a charging device 20 which overlies the latent image holding member 10 so as to face the latent image holding member 10 and which charges the surface of the latent image holding member 10, an exposure device 30 which exposes the surface of the latent image holding member 10 charged by the charging device 20 to light to form an electrostatic latent image, a developing device 40 which attaches toner contained in a developer to the electrostatic latent image formed by the exposure device 30 through a contact development process to form a toner image on the surface of the latent image holding member 10, a belt-shaped intermediate transfer body 50 which runs in the direction denoted by the arrow b in contact with the latent image holding member 10 and to which the toner image formed on the surface of the latent image holding member 10 is transferred, and a cleaning device 70 which cleans the surface of the latent image holding member 10.

The charging device 20, the exposure device 30, the developing device 40, the intermediate transfer body 50, and the cleaning device 70 are disposed clockwise in this order so as to surround the circumference of the latent image holding member 10.

The intermediate transfer body 50 is supported by supporting rollers 50A and 50B, a back roller 50C, and a driving roller 50D under tension given from the inside and driven in the direction denoted by the arrow b by the rotation of the driving roller 50D. A first transfer device 51 is provided inside the intermediate transfer body 50 at the position facing the latent image holding member 10 and charges the intermediate transfer body 50 in the polarity different from that of the charged toner to make the toner on the latent image holding member 10 adhere to the outer surface of the intermediate transfer body 50. A second transfer device 52 is disposed outside and below the intermediate transfer body 50 so as to face the back roller 50C and charges recording paper P as a recording medium in the polarity different from that of the charged toner to transfer the toner image on the intermediate transfer body 50 to the recording paper P.

Furthermore, the following devices are provided below the intermediate transfer body 50: a recording paper supplying device 53 that supplies the recording paper P to the second transfer device 52 and a fixing device 80 that transports the recording paper P having the toner image transferred by the second transfer device 52 and that fixes the toner image.

The recording paper supplying device 53 includes a pair of transport rollers 53A and a guide plate 53B that guides the recording paper P transported by the transport rollers 53A toward the second transfer device 52. The fixing device 80 includes fixing rollers 81 that are a pair of heat rollers and that heat and press the recording paper P having the toner image transferred by the second transfer device 52 to fix the toner image and a transport body 82 that transports the recording paper P toward the fixing rollers 81.

The recording paper P is transported by the recording paper supplying device 53, the second transfer device 52, and the fixing device 80 in the direction denoted by the arrow c.

The intermediate transfer body 50 further includes an intermediate transfer body cleaning device 54 having a cleaning blade 55 that removes toner remaining on the intermediate transfer body 50 after the second transfer device 52 transfers a toner image to the recording paper P.

Examples of the latent image holding member 10 include inorganic photoreceptors of which a photosensitive layer is formed of an inorganic material on a conductive substrate and organic photoreceptors of which the photosensitive layer is formed of an organic material. An example of the organic photoreceptors is a functionally separated photoreceptor including a conductive substrate, a charge generating layer that is exposed to light to generate charges, and a charge transporting layer that transports the charges, the charge generating layer and the charge transporting layer overlying the conductive substrate. Another example of the organic photoreceptors is a photoreceptor including a conductive substrate and a single-layer photosensitive layer that is disposed on the conductive substrate to function both for generation of charges and for transport of the charges. An example of the inorganic photoreceptors is a photoreceptor including a conductive substrate and a photosensitive layer formed of amorphous silicon on the conductive substrate. The latent image holding member 10 used in the exemplary embodiment has a cylindrical shape but is not limited thereto; it may be in another form such as a sheet or a plate.

Examples of the charging device 20 include contact-type chargers that involve use of a conductive charging roller, a charging brush, a charging film, a charging rubber blade, a charging tube, or another member. Other examples of the charging device 20 include a non-contact-type roller charger and a scorotron or corotron charger in which corona discharge is utilized. In the exemplary embodiment, a scorotron charger in which corona discharge is utilized is employed as an example. The surface of the latent image holding member 10 may be charged in any polarity by the charging device 20; in the exemplary embodiment, it is charged in negative polarity.

Examples of the exposure device 30 include optical systems that expose the surface of the latent image holding member 10 to light, such as light emitted from a semiconductor laser, a light emitting diode (LED), or a liquid crystal shutter, in the shape of an image. The wavelength of the light source is properly within the spectral sensitivity of the latent image holding member 10. The light from a semiconductor laser is, for instance, suitably near-infrared light having an oscillation wavelength near 780 nm. The wavelength of the light is, however, not limited thereto; laser light having an oscillation wavelength of the order of 600 nm or blue laser light having an oscillation wavelength ranging from 400 nm to 450 nm may be employed. The exposure device 30 may be, for example, a surface-emitting laser source that can emit multiple beams for formation of color images.

The developing device 40 is, for example, disposed so as to face the latent image holding member 10 in a development region and includes a development container 41 that contains a developer containing toner and a carrier (two-component developer). The development container 41 has a development container body 41A and a development container cover 41B that covers the top of the development container body 41A. The term "development region" herein refers to the region in which an electrostatic latent image formed on the latent image holding member 10 is developed by the developing device 40.

The inside of the development container body 41A, for instance, has a developing roller chamber 42A that accommodates a developing roller 42, a first stirring chamber 43A adjacent to the developing roller chamber 42A, and a second stirring chamber 44A adjacent to the first stirring chamber 43A. The inside of the developing roller chamber 42A, for example, has a thickness controlling member 45 that controls the thickness of the layer of the developer on the surface of the developing roller 42 in a state in which the development container cover 41B has been attached to the development container body 41A.

The first stirring chamber 43A and the second stirring chamber 44A are, for example, separated from each other by a partition 41C. The first stirring chamber 43A and the second stirring chamber 44A are in connection with each other through openings (not illustrated) formed on the both ends of the partition 41C in the longitudinal direction thereof (longitudinal direction of the developing device) and form a circulation stirring chamber in this manner.

In the developing roller chamber 42A, the developing roller 42 is disposed so as to face the latent image holding member 10. The developing roller 42 includes a magnetic roller (stationary magnet) and a sleeve provided on the outside of the magnetic roller, although not illustrated. The developer inside the first stirring chamber 43A adheres to the surface of the developing roller 42 owing to the magnetic force of the magnetic roller and is transported to the development region. The roller shaft of the developing roller 42 is rotatably supported by the development container body 41A. The developing roller 42 and the latent image holding member 10 rotate in opposite directions, and the developer adhering to the surface of the developing roller 42 is transported to the development region in the same direction as the rotational direction of the latent image holding member 10 at the position at which the developing roller 42 and the latent image holding member 10 face each other.

The sleeve of the developing roller 42 is connected to a bias supply (not illustrated), and a developing bias is applied to the development region. In the exemplary embodiment, the developing bias is a bias in which an alternating-current (AC) component from an AC power source has been superimposed on a direct-current (DC) component from a DC power source, so that an alternating electric field is applied. The polarity of the direct-current bias voltage applied to the developing roller 42 is opposite to the polarity of the charged toner and positive in the exemplary embodiment.

The first stirring chamber 43A and the second stirring chamber 44A have a first stirring member 43 and second stirring member 44 that transport the developer while stirring it, respectively. The first stirring member 43 has a first rotational shaft extending in the direction of the shaft of the developing roller 42 and a helical stirring transport blade (protrusion) fixed to the circumference of the rotational shaft. Likewise, the second stirring member 44 has a second rotational shaft and a stirring transport blade (protrusion). The first stirring member 43 and the second stirring member 44 are rotatably supported by the development container body 41A. The first stirring member 43 and the second stirring member 44 are disposed such that the rotations thereof enable the developers inside the first stirring chamber 43A and the second stirring chamber 44A to be transported in the opposite directions. In the exemplary embodiment, the developer inside the development container 41 is not only stirred and transported but also charged by the first stirring member 43 and the second stirring member 44. The developer may be charged in any polarity; in the exemplary embodiment, it is charged in negative polarity.

One end of the second stirring chamber 44A in the longitudinal direction is connected to one end of a supply channel 46 through which a supplemental toner is supplied to the second stirring chamber 44A, and the other end of the supply channel 46 is connected to a supplying device 60 that contains and supplies the supplemental toner. In the image forming apparatus 100 according to the exemplary embodiment, such a structure enables supply of the supplemental toner from the supplying device 60 to the developing device 40 (second stirring chamber 44A) through the supply channel 46. The structure of the supplying device 60 will be described later in detail.

Examples of the first transfer device 51 and second transfer device 52 include known transfer chargers such as contact-type transfer chargers having a belt, a roller, a film, or a rubber blade and transfer chargers in which corona discharge is utilized, e.g., a scorotron transfer charger and a corotron transfer charger. A transfer bias is applied to the first transfer device 51 to transfer the toner adhering to the latent image holding member 10 to the intermediate transfer body 50. A transfer bias is also applied to the second transfer device 52 from a power source (not illustrated) to transfer the toner adhering to the intermediate transfer body 50 to the recording paper P.

The intermediate transfer body 50 is in the form of a belt (intermediate transfer belt) containing a conductive agent and formed of polyimide, polyamide imide, polycarbonate, polyarylate, polyester, or rubber. The intermediate transfer body 50 may be in a different form from a belt, such as a cylinder.

The cleaning device 70 includes a housing 71 and a cleaning blade 72 disposed so as to protrude from the housing 71. The cleaning blade 72 may be supported by an end of the housing 71 or by an additionally provided supporting member (holder). In the exemplary embodiment, the cleaning blade 72 is supported by an end of the housing 71.

Figure 2:
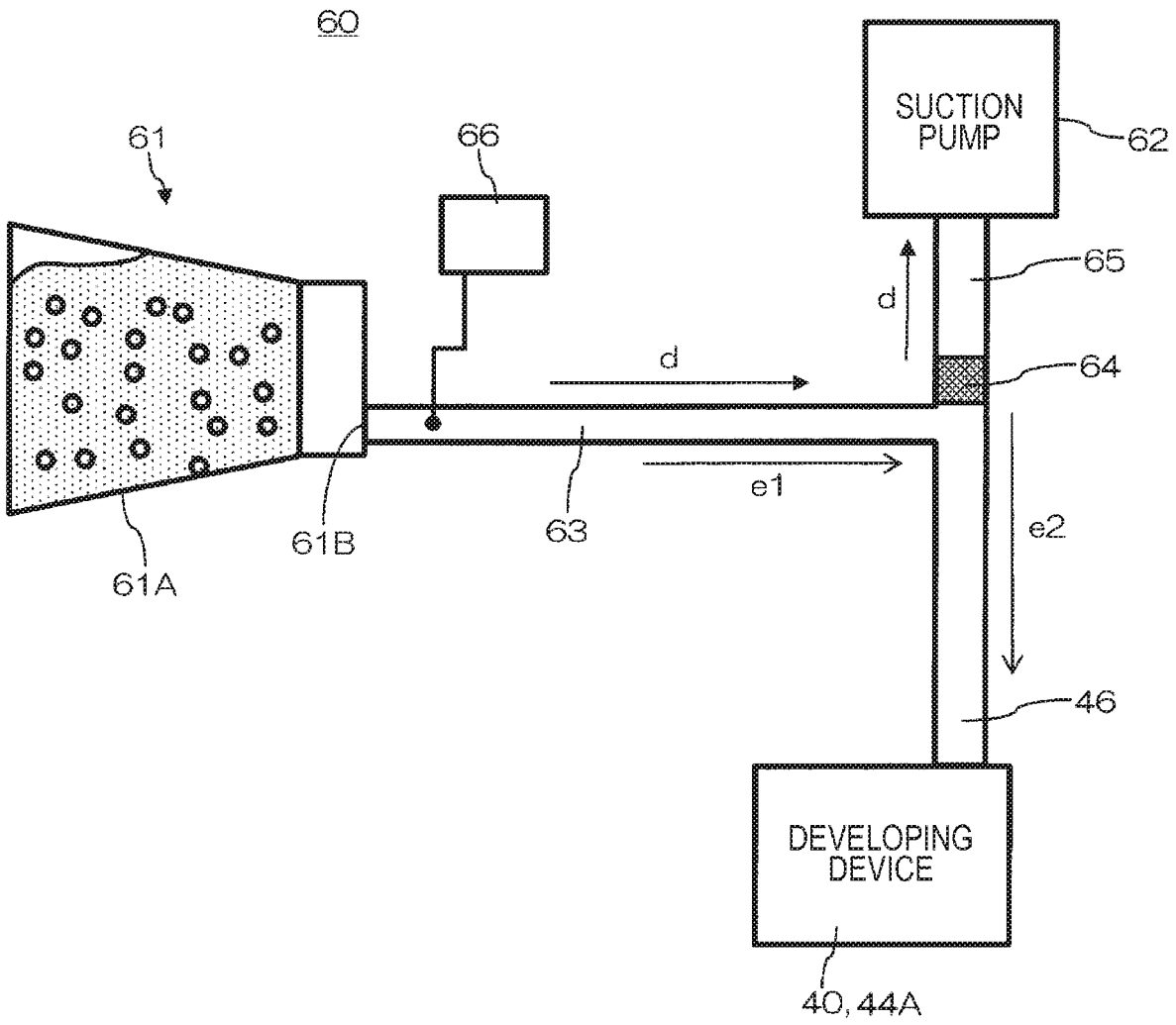
FIG. 2 schematically illustrates an example of the structure of a supplying device according to the exemplary embodiment.

FIG. 2 illustrates the supplying device 60 that supplies the supplemental toner to the developing device 40. The supplying device 60 includes a toner cartridge 61 (storage unit) that stores the toner, a suction pump 62 (transport unit), a toner transport channel 63, a filter 64, and a vent pipe 65. The toner cartridge 61 is at least partially formed of a flexible material and has a bag 61A which deforms in response to a change in the internal atmospheric pressure and a toner discharge port 61B from which the toner inside the bag 61A is discharged.

The supply of the toner by the supplying device 60 will now be described. The operation of the suction pump 62 causes the gas inside the toner transport channel 63 and the toner cartridge 61 to be discharged through the filter 64 and the vent pipe 65. This causes the flow of the gas denoted by the arrow d in FIG. 2. The toner inside the toner cartridge 61 moves rightward along this flow of the gas as indicated by the arrow e1 in FIG. 2. In this process, a reduction in the inner pressure of the toner cartridge 61 causes deformation of the bag 61A and thus a reduction in the volume thereof, which promotes the movement of the toner inside the bag 61A to the toner discharge port 61B. The toner moving along the flow of the gas reaches the filter 64, and the filter 64 allows the gas to pass but blocks the toner; thus, the toner stops at the filter 64. Then, the toner remaining at the filter 64 drops owing to gravity in the direction denoted by the arrow e2 in FIG. 2 and is supplied to the second stirring chamber 44A of the developing device 40 through the supply channel 46. In the exemplary embodiment, the toner is transported from the toner cartridge 61 with the suction pressure generated by the suction pump 62 in this manner.

In the supply of the toner by the supplying device 60, the operation of the suction pump 62 may be, for example, controlled on the basis of atmospheric pressure in the toner discharge port 61B of the toner cartridge 61. Specifically, a pressure sensor 66 is provided at the toner-discharge-port-61B-side end of the toner transport channel 63 as illustrated in FIG. 2 to measure atmospheric pressure inside the toner transport channel 63. The pressure sensor 66 sends a detection signal based on the measured atmospheric pressure to a controller (not illustrated), and the controller controls turning on and off of the suction pump 62 on the basis of the detection signal sent from the pressure sensor 66 and on a map preliminarily stored in a memory or another device.

In the supply of the toner by the supplying device 60, the atmospheric pressure in the toner discharge port 61B and the toner transport channel 63 maybe, for example, from 0.1 mPa to 0.5 mPa, and suitably from 0.2 mPa to 0.4 mPa although it depends on the supply rate of the toner. Unnecessarily high atmospheric pressure causes the flow of the gas that carries the toner to be weak, which may result in that the transport of the toner takes too long duration of time; unnecessarily low atmospheric pressure causes the flow of the gas that carries the toner to be strong, which may result in that the control of the amount of the toner that is to be transported becomes hard. In the supplying device 60 used in the exemplary embodiment, the position at which the pressure sensor 66 is disposed is not limited to the position in FIG. 2; for instance, it may be disposed in the toner transport channel 63 so as to be apart from the toner discharge port 61B or may be disposed inside the vent pipe 65 or the supply channel 46. The operation of the suction pump 62 may be controlled on the basis of the amount of the toner supplied to the developing device 40, which is detected by a well-known technique.

The bag 61A of the toner cartridge 61 is at least partially formed of a flexible material. Examples of usable flexible materials include polymeric materials; and specific examples thereof include polyolefin, polyamide, polyurethane, polyamide elastomers, polyester elastomers, polyurethane elastomers, polystyrene elastomers, fluorine elastomers, silicone rubber, latex rubber, and a combination of two or more of the foregoing. The bag 61A is suitably formed of polyolefin in terms of flexibility and strength. The thickness of the bag 61A may be appropriately adjusted on the basis of the type of a material to be used; it may be from 0.03 mm to 1.0 mm, and suitably from 0.05 mm to 0.5 mm in terms of flexibility and strength. The toner cartridge 61 may have a case that accommodates the bag 61A in terms of protection and conveyance of the bag 61A and easy storage.

The suction pump 62 can be any of known pumps. Examples thereof include a rotary pump, a diaphragm pump, a water jet pump, and a dry pump. The toner transport channel 63 has a branched structure as illustrated in FIG. 2; and the branched structure includes a section extending in the lateral direction and connected to the toner cartridge 61, another section extending upward and connected to the filter 64 and the vent pipe 65, and another section extending downward and connected to the supply channel 46. In the supplying device 60 illustrated in FIG. 2, part of the toner transport channel 63 from the filter 64 to the supply channel 46 extends along the vertical direction, so that toner remaining at the filter 64 is supplied to the developing device 40 through the supply channel 46. Such part of the toner transport channel 63 from the filter 64 to the supply channel 46 may have any shape provided that the toner can move downward to the developing device 40 owing to gravity; for example, it may be tilted from the vertical direction.

The filter 64 blocks the toner but allows gas to pass and thus can separate the toner from the gas. The filter 64 can be any of filters provided that it has such a function; for example, a porous resin film having many pores can be used. The pore size of the porous resin film may be, for example, 2 μm or less, and suitably from 0.1 μm to 2 μm in terms of gas permeability. Such a porous resin film is, for instance, formed of a fluororesin. The filter 64 is, for example, air-tightly attached to the inner surface of the vent pipe 65 with an adhesive.

A process for forming images by the image forming apparatus 100 according to the exemplary embodiment (method for forming images) will now be described.

In the image forming apparatus 100 according to the exemplary embodiment, the latent image holding member 10 rotates in the direction denoted by the arrow a, and the charging device 20 begins the charging process. The surface of the latent image holding member 10 that has been charged by the charging device 20 is exposed to light by the exposure device 30 to form an electrostatic latent image on the surface. When part of the latent image holding member 10 having the electrostatic latent image comes close to the developing device 40, the magnetic brush of a developer on the surface of the developing roller 42 of the developing device 40 contacts with the image holding member 10, and then the toner adheres to the electrostatic latent image to form a toner image. The latent image holding member 10 having the toner image further rotates in the direction denoted by the arrow a, and then the toner image is transferred to the outer surface of the intermediate transfer body 50. After the transfer of the toner image to the intermediate transfer body 50, the recording paper P is supplied from the recording paper supplying device 53 to the second transfer device 52, and the second transfer device 52 transfers the toner image on the intermediate transfer body 50 to the recording paper P. Through this process, the toner image is formed on the recording paper P. The toner image on the recording P is fixed by the fixing device 80.

After the toner image on the latent image holding member 10 is transferred to the intermediate transfer body 50, residual toner and corona products remaining on the surface of the latent image holding member 10 are removed with the cleaning blade 72 of the cleaning device 70. The latent image holding member 10 after the removal of the residual toner and corona products by the cleaning device 70 is charged again by the charging device 20 and exposed to light by the exposure device 30 to form an electrostatic latent image.

The structure of the image forming apparatus 100 according to the exemplary embodiment is not limited to the above-mentioned structure. A first erasing device that makes the polarity of residual toner being even to easily remove the residual toner with a cleaning brush or another member may be, for example, provided in the vicinity of the latent image holding device 10 downstream of the first transfer device 51 and upstream of the cleaning device 70 in the rotational direction of the latent image holding device 10. In addition, a second erasing device that removes charges from the surface of the latent image holding member 10 may be further provided downstream of the cleaning device 70 and upstream of the charging device 20 in the rotational direction of the latent image holding member 10.

The toner image formed on the latent image holding member 10 may be, for instance, directly transferred to the recording paper P; alternatively, the image forming apparatus 100 may be a tandem type.

Composition of Toner

The toner used for developing an electrostatic latent image in the image forming apparatus 100 according to the exemplary embodiment will now be described.

The toner used in the exemplary embodiment contains a polyester resin as a binder resin; when a tetrahydrofuran (THF)-soluble component of the toner (also referred to as "THF-soluble component") is analyzed by gel permeation chromatography (GPC) to determine a weight average molecular weight Mw and a number average molecular weight Mn, the Mw is from 10,000 to 60,000, and Mw/Mn is from 5 to 10. Furthermore, in the absorption spectrum of the toner that is obtained by infrared absorption spectroscopy, the ratio (P2/P1) of the peak height of the absorption peak at a wavenumber of 820 $cm^{-1}$ (P2) to the peak height of the absorption peak at a wavenumber of 720 $cm^{-1}$ (P1) is 0.4 or less, and the ratio (P3/P1) of the peak height of the absorption peak at a wavenumber of 1500 $cm^{-1}$ (P3) to the peak height of the absorption peak at a wavenumber of 720 $cm^{-1}$ (P1) is 0.6 or less.

The toner used in the exemplary embodiment contains a polyester resin as a binder resin. Any of known polyester resins can be used; and examples of the polyester resin include polycondensates of a polycarboxylic acid with a polyhydric alcohol. The polyester resin may be a commercially available product or may be a synthesized resin.

Examples of the polycarboxylic acid used as a material of the polyester resin include aliphatic dicarboxylic acids (such as oxalic acid, malonic acid, maleic acid, fumaric acid, citraconic acid, itaconic acid, glutaconic acid, succinic acid, alkenylsuccinic acid, adipic acid, and sebacic acid); alicyclic dicarboxylic acids (such as cyclohexanedicarboxylic acid); aromatic dicarboxylic acids (such as terephthalic acid, isophthalic acid, phthalic acid, and naphthalenedicarboxylic acid); anhydrides of the foregoing; and lower alkyl esters (having, for example, from 1 to 5 carbon atoms) of the foregoing. Of these, for example, aromatic dicarboxylic acids are suitably employed as the polycarboxylic acid.

The polycarboxylic acid may be a combination of the dicarboxylic acid with a carboxylic acid that has three or more carboxy groups and that gives a cross-linked structure or a branched structure. Examples of the carboxylic acid having three or more carboxy groups include trimellitic acid and pyromellitic acid, anhydrides of the foregoing, and lower alkyl esters (having, for example, from 1 to 5 carbon atoms) of the foregoing. Such polycarboxylic acids may be used alone or in combination.

Examples of the polyhydric alcohol include aliphatic diols (such as ethylene glycol, diethylene glycol, triethylene glycol, propylene glycol, butanediol, hexanediol, and neopentyl glycol); alicyclic diols (such as cyclohexanediol, cyclohexanedimethanol, and hydrogenated bisphenol A); and aromatic diols (such as ethylene oxide adducts of bisphenol A and propylene oxide adducts of bisphenol A). In the exemplary embodiment, the polyhydric alcohol used as a material of the polyester resin is preferably not aromatic diols but aliphatic diols or alicyclic diols, and especially preferably aliphatic diols in order to produce toner having the above-mentioned specific absorption spectrum.

The polyhydric alcohol may be a combination of the diol with a polyhydric alcohol that has three or more hydroxy groups and that gives a cross-linked structure or a branched structure. Examples of the polyhydric alcohol having three or more hydroxy groups include glycerin, trimethylolpropane, and pentaerythritol. Such polyhydric alcohols may be used alone or in combination.

The polyester resin has a glass transition temperature (Tg) ranging preferably from 50° C. to 80° C., and more preferably from 50° C. to 65° C. The glass transition temperature can be determined from a DSC curve obtained by differential scanning calorimetry (DSC); for example, it can be specifically determined in accordance with JIS K 7121-1987 "Testing Methods for Transition Temperatures of Plastics".

The polyester resin has a weight average molecular weight (Mw) ranging preferably from 5,000 to 1,000,000, and more preferably from 7,000 to 500,000. The polyester resin suitably has a number average molecular weight (Mn) ranging from 2,000 to 100,000. The polyester resin has a molecular weight distribution Mw/Mn ranging preferably from 1.5 to 100, and more preferably from 2 to 60.

The weight average molecular weight and number average molecular weight of the polyester resin are, for instance, determined by gel permeation chromatography (GPC). The determination of the molecular weights by GPC involves using a measurement apparatus that is GPC•HLC-8120 manufactured by Tosoh Corporation, a column that is TSK gel Super HM-M (15 cm) manufactured by Tosoh Corporation, and a THF solvent. From results of GPC, the weight average molecular weight and the number average molecular weight are calculated from a molecular weight calibration curve plotted on the basis of a standard sample of monodisperse polystyrene.

The polyester resin can be synthesized through the polycondensation reaction of the polycarboxylic acid with the polyhydric alcohol by any of known techniques. In particular, the polyester resin is, for example, produced through the reaction of the polycarboxylic acid with the polyhydric alcohol at a polymerization temperature ranging from 180° C. to 230° C. optionally under reduced pressure in the reaction system, while water or alcohol that is generated in condensation is removed.

In the case where monomers as the raw materials are not dissolved or compatible at the reaction temperature, a solvent having a high boiling point may be used as a solubilizing agent in order to dissolve the raw materials. In such a case, the polycondensation reaction is performed while the solubilizing agent is distilled away. In the case where monomers having low compatibility in the copolymerization reaction are used, such monomers are preliminarily subjected to condensation with an acid or alcohol that is to undergo polycondensation with the monomers, and then the resulting product is subjected to polycondensation with the principle components.

The toner used in the exemplary embodiment may contain another resin different from the polyester resin as a binder resin. Examples of such a resin different from the polyester resin include vinyl resins that are homopolymers of monomers such as styrenes (such as styrene, p-chlorostyrene, and α-methylstyrene), (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene) or copolymers of two or more of these monomers.

In addition to the polyester resin and the vinyl resin, any of non-vinyl resins such as epoxy resins, polyurethane resins, polyamide resins, cellulose resins, polyether resins, and modified rosin; mixtures thereof with the above-mentioned vinyl resins; and graft polymers obtained by polymerization of a vinyl monomer in the coexistence of such non-vinyl resins may be used as the binder resin.

In the exemplary embodiment, the amount of the crystalline resin is preferably from 3 mass % to 20 mass %, and more preferably from 5 mass % to 15 mass % relative to the amount of the whole toner. The toner that contains the crystalline resin in such an amount has a low moisture absorption property and is less likely to suffer the coagulation and accumulation in the toner cartridge in a high temperature and high humidity environment.

In the exemplary embodiment, the term "crystalline" of the crystalline resin refers to that the resin or the toner does not show a step-like change in the amount of endothermic energy but shows an endothermic peak in an analysis by differential scanning calorimetry (DSC). Specifically, in differential scanning calorimetry using a differential scanning calorimeter (name of apparatus: DSC-50 type, manufactured by SHIMADZU CORPORATION) which has an automatic tangent line processing system, temperature is increased at a temperature increase rate of 10° C./min, then decreased with liquid nitrogen, and increased again at 10° C./min; in this case, when the temperature from an onset point to the peak top of the endothermic peak is within 10° C., this is counted as the presence of an endothermic peak. In the DSC curve, a point on the flat part corresponding to a baseline and a point on the flat part of the fall from the baseline are determined, and the intersection of tangent lines of the flat parts between both the points is calculated as an onset point by the automatic tangent line processing system. In the case where a resin does not show an endothermic peak but shows a step-like change in the amount of endothermic energy, this resin is "amorphous". Such an amorphous resin is solid at room temperature (20° C.) and thermoplasticized at a temperature greater than or equal to glass transition temperature. Moreover, the amorphous resin does not show an endothermic peak corresponding to a crystalline melting point in the differential scanning calorimetry, while it shows the step-like endothermic point corresponding to glass transition.

The crystalline resin contained in the toner used in the exemplary embodiment can be any of resins having a crystallinity, and specific examples thereof include crystalline polyester resins and crystalline vinyl resins. The crystallinity of the resin can be controlled by changing the types and content proportions of raw material monomers. Examples of the crystalline polyester resin include polycondensates of a polycarboxylic acid with a polyhydric alcohol. The crystalline polyester resin may be a commercially available product or a synthesized resin. The crystalline polyester resin may be suitably a polycondensate prepared from polymerizable monomers having linear aliphatics rather than a polycondensate prepared from polymerizable monomers having aromatics in terms of easy formation of a crystal structure.

Examples of the polycarboxylic acid used as a material of the crystalline polyester resin include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid); aromatic dicarboxylic acids (e.g., dibasic acids such as phthalic acid, isophthalic acid, terephthalic acid, and naphthalene-2,6-dicarboxylic acid); anhydrides of these dicarboxylic acids; and lower alkyl esters (having, for example, from 1 to 5 carbon atoms) of these dicarboxylic acids.

The polycarboxylic acid may be a combination of the dicarboxylic acid with a carboxylic acid that has three or more carboxy groups and that gives a cross-linked structure or a branched structure. Examples of the carboxylic acid having three carboxy groups include aromatic carboxylic acids (such as 1,2,3-benzenetricarboxylic acid, 1,2,4-benzenetricarboxylic acid, and 1,2,4-naphthalenetricarboxylic acid); anhydrides of these tricarboxylic acids; and lower alkyl esters (having, for example, from 1 to 5 carbon atoms) of these tricarboxylic acids. The polycarboxylic acid may be a combination of these dicarboxylic acids with a dicarboxylic acid having a sulfonic group or a dicarboxylic acid having an ethylenic double bond. The polycarboxylic acids may be used alone or in combination.

Examples of the polyhydric alcohol used as a material of the crystalline polyester resin include aliphatic diols (such as linear aliphatic diols having a backbone with from 7 to 20 carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol are suitable.

The polyhydric alcohol may be a combination of the diol with an alcohol that has three or more hydroxy groups and that gives a cross-linked structure or a branched structure. Examples of the alcohol having three or more hydroxy groups include glycerin, trimethylolethane, trimethylolpropane, and pentaerythritol. The polyhydric alcohols may be used alone or in combination. The aliphatic diol content in the polyhydric alcohol may be 80 mol % or more, and suitably 90 mol % or more.

The melting temperature of the crystalline polyester resin is, for example, preferably from 50° C. to 100° C., more preferably from 55° C. to 90° C., and further preferably from 60° C. to 85° C. The melting temperature is determined from a DSC curve obtained by differential scanning calorimetry (DSC) in accordance with "Melting Peak Temperature" described in determination of melting temperature in JIS K 7121-1987 "Testing Methods for Transition Temperatures of Plastics". The weight average molecular weight (Mw) of the crystalline polyester resin is, for instance, suitably from 6,000 to 35,000. The crystalline polyester resin can be, for example, produced by any of known techniques as in production of the amorphous polyester resin.

The amount of the binder resin is, for instance, suitably from 40 mass % to 95 mass %, preferably from 50 mass % to 90 mass %, and more preferably from 60 mass % to 85 mass % relative to the whole toner.

The toner used in the exemplary embodiment may optionally contain other additives such as a colorant, a release agent, a charge-controlling agent, silica powder, and a metal oxide. These additives may be internally added by being kneaded with the binder resin; alternatively, the particles of the additives may be externally added by mixing with a produced toner.

The colorant can be any of known pigments and may optionally contain any of known dyes. In particular, pigments such as yellow, magenta, cyan, and black pigments are used. Examples of the yellow pigments include condensed azo compounds, isoindolinone compounds, anthraquinone compounds, azo metal complex compounds, methane compounds, and arylamide compounds. Examples of the magenta pigments include condensed azo compounds, diketopyrrolopyrrole compounds, anthraquinones, quinacridone compounds, lake compounds of basic dyes, naphthol compounds, benzimidazolone compounds, thioindigo compounds, and perylene compounds. Examples of the cyan pigments include copper phthalocyanine compounds and the derivatives thereof, anthraquinone compounds, and lake compounds of basic dyes. Examples of the black pigments include carbon black, aniline black, acetylene black, and iron black. The amount of the colorant is, for example, in the range of 5 mass % to 20 mass % relative to the whole toner.

Examples of a release agent include, but are not limited to, hydrocarbon waxes;

natural waxes such as a carnauba wax, a rice bran wax, and a candelilla wax; synthetic or mineral/petroleum waxes such as a montan wax; and ester waxes such as a fatty acid ester and a montanic acid ester. The melting temperature of the release agent is preferably from 50° C. to 110° C., and more preferably from 60° C. to 100° C. The melting temperature is determined from a DSC curve obtained by differential scanning calorimetry (DSC) as "melting peak temperature" described in determination of melting temperature in JIS K 7121-1987 "Testing Methods for Transition Temperatures of Plastics". The amount of the release agent is, for example, preferably from 1 mass % to 20 mass %, and more preferably from 5 mass % to 15 mass % relative to the whole toner.

Examples of other additives include known additives such as a magnetic material and inorganic powder. These additives are contained in the toner as internal additives.

Method for Producing Toner

The toner used in the exemplary embodiment may be produced by any method; for example, it can be a pulverized toner, in-liquid-emulsified dry toner, or polymerized toner produced by any of known methods.

The binder resin, the colorant, and other additives are, for example, put into a mixer such as a HENSCHEL MIXER and then mixed with each other. The mixture is melt-kneaded with a twin-screw extruder, a Banbury mixer, a roll mill, a kneader, or another apparatus; cooled with a drum flaker or another apparatus; and roughly pulverized with a pulverizer such as a hammer mill. Then, the resulting product is further pulverized with a pulverizer such as a jet mill and classified with an air classifier or another apparatus to yield a pulverized toner.

The binder resin, the colorant, and other additives are dissolved in a solvent such as ethyl acetate and emulsified and suspended in a liquid to which a dispersion stabilizer such as calcium carbonate has been added. The solvent and the dispersion stabilizer are removed in sequence, and the resulting particles are filtered and dried to yield an in-liquid-emulsified dry toner.

A composition containing a polymerizable monomer used as a material of the binder resin, a colorant, a polymerization initiator (such as benzoyl peroxide, lauryl peroxide, isopropyl peroxycarbonate, cumene hydroperoxide, 2,4-dichlorobenzoyl peroxide, and methyl ethyl ketone peroxide), and other additives is added to an aqueous phase under stirring to granulate. After the polymerization reaction, the particles are filtered and dried to yield a polymerized toner.

The content proportion of the materials used for producing the toner (such as the binder resin, the colorant, and other additives) may be determined in view of demand characteristics, fixability at low temperature, color, and another property. The produced toner is pulverized in a carrier oil with a known pulverizer, such as a ball mill, a bead mill, or a high-pressure wet atomizer, to obtain a toner for a liquid developer, which is used in the exemplary embodiment.

Characteristics of Toner

In the case where the toner used in the exemplary embodiment is dissolved in tetrahydrofuran (THF) and where its soluble component (hereinafter also referred to as "THF-soluble component") is analyzed by gel permeation chromatography (GPC) to determine a weight average molecular weight Mw and a number average molecular weight Mn, the Mw is from 10,000 to 60,000, and the ratio Mw/Mn of the Mw to the Mn is from 5 to 10 as described above.

The toner of which the Mw of the THF-soluble component is from 10,000 to 60,000 is excellent in fixability as compared with the toner of which the Mw of the THF-soluble component is less than 10,000 or greater than 60,000. In the case where the Mw of the THF-soluble component is less than 10,000, hot offset is highly likely to occur in the fixing process of the toner even though the gel content exists; in the case where the Mw of the THF-soluble component is greater than 60,000, a crease minimum fixing temperature (MFT), which is the temperature at which a toner image on a substrate is not separated from the substrate when the substrate is bent, is high. Accordingly, the Mw of the THF-soluble component is suitably from 25,000 to 50,000.

The toner of which the THF-soluble component has a ratio Mw/Mn ranging from 5 to 10 exhibits low technical difficulty in production of the binder resin and can be produced at cheap costs as compared with the toner of which the THF-soluble component has a ratio Mw/Mn of less than 5. In addition, it has a small variation in melting property relative to a fixing temperature, is less likely to cause unevenness in a fixed image, and gives the fixed image excellent quality as compared with the toner of which the THF-soluble component has a ratio Mw/Mn of greater than 10. Accordingly, the ratio Mw/Mn of the THF-soluble component is suitably from 6 to 8.

The weight average molecular weight Mw and number average molecular weight Mn of the THF-soluble component of the toner particles are determined by GPC as follows. Into 1 g of tetrahydrofuran (THF), 0.5 mg of toner particles (or toner) that are to be analyzed are dissolved. The solution is subjected to ultrasonic dispersion, the concentration of the toner particles is adjusted to be 0.5 mass %, and then the dissolved component thereof is analyzed by GPC. A GPC apparatus to be used is "HLC-8120GPC, SC-8020 (manufactured by Tosoh Corporation)", two columns of "TSKgel, SUPERHM-H (manufactured by Tosoh Corporation, 6.0 mm ID×15 cm)" are used, and THF is used as an eluent. The concentration of the sample is 0.5%, the flow rate is 0.6 ml/min, the injection amount of the sample is 10 μl, the measurement temperature is 40° C., and a refractive index (RI) detector is used. The calibration curve is determined from 10 samples of "polystyrene standard sample of TSK standard" manufactured by Tosoh Corporation: "A-500", "F-1", "F-10", "F-80", "F-380", "A-2500", "F-4", "F-40", "F-128", and "F-700".

As described above, in the case where the absorption spectrum (hereinafter also referred to as "IR spectrum") of the toner used in the exemplary embodiment is determined by infrared absorption spectroscopy, the ratio (P2/P1) of the peak absorption around a wavenumber of 820 $cm^{-1}$ (P2) to the peak absorption around a wavenumber of 720 $cm^{-1}$ (P1) is 0.4 or less, and suitably 0.3 or less. The ratio (P2/P1) is preferably 0.05 or more, and more preferably 0.08 or more.

In the IR spectrum of the toner used in the exemplary embodiment, and the ratio (P3/P1) of the peak absorption around a wavenumber of 1500 $cm^{-1}$ (P3) to the peak absorption around a wavenumber of 720 $cm^{-1}$ (P1) is 0.6 or less, and suitably 0.5 or less. The ratio (P3/P1) is preferably 0.2 or more, and more preferably 0.3 or more. The toner having the ratios (P2/P1) and (P3/P1) within the above-mentioned ranges in the IR spectrum has a further enhanced fixability. In the case where the ratio (P2/P1) in the IR spectrum is 0.05 or more and where the ratio (P3/P1) is 0.2 or more, the toner is excellent in the storability of the toner particles and therefore more suitable.

In the IR spectrum of the toner, the ratio (P2/P3) of the peak absorption around a wavenumber of 820 $cm^{-1}$ (P2) to the peak absorption around a wavenumber of 1500 $cm^{-1}$ (P3) is preferably 0.5 or less, and more preferably 0.4 or less. The ratio (P2/P3) is preferably 0.1 or more, and more preferably 0.15 or more. At a ratio (P2/P3) of greater than 0.5, the strength of the toner particles may decrease; at a ratio (P2/P3) of less than 0.1, the storability of the toner particles may decrease.

The absorption spectrum of the toner is obtained by infrared absorption spectrometry as follows: 40 mg of KBr powder and 0.2 mg (concentration: 0.5%) of toner to be analyzed are well pulverized and mixed with each other with a mortar, the resulting product is pressure-molded into a sample, and then the sample is analyzed with a Fourier transform infrared spectrometer (FTIR-410 manufactured by JASCO Corporation). The obtained absorption spectrum of the toner is used to determine the peak absorption (peak intensity) of the absorption peak for each of the wavenumbers as specified below.

The absorbance at the individual wavenumbers is measured by infrared absorption spectrometry as follows. Toner particles (or toner) that are to be analyzed are formed into a test sample by a KBr pellet technique. The test sample is analyzed in the wavenumber range of 500 $cm^{-1}$ to 4000 $cm^{-1}$ with an infrared spectrophotometer (FT-IR-410 manufactured by JASCO Corporation) at number of integration of 300 times and resolution of 4 $cm^{-1}$. Baseline correction is carried out at, for instance, an offset part having no light absorption to determine the absorbance at the individual wavenumbers. The terms "around 720 $cm^{-1}$", "around 820 $cm^{-1}$", and "around 1500 $cm^{-1}$" refer to wavenumbers of "720±20 $cm^{-1}$", "820±20 $cm^{-1}$", and "1500±20 $cm^{-1}$", respectively.

The peak around 720 $cm^{-1}$ is a bending vibration based on the carbon-hydrogen bond (C—H bond) of the aliphatic chain and derived from the aliphatic chain of the polyester resin. The peak around 820 $cm^{-1}$ is an out-of-plane bending vibration based on the carbon-hydrogen bond (C—H bond) of the aromatic ring and derived from adjoining hydrogens on the benzene ring of bisphenol in the case where the toner contains a bisphenol derivative such as bisphenol A. The peak around 1500 $cm^{-1}$ is a stretching vibration based on the carbon-carbon double bond (C=C bond) of the aromatic ring and derived from the benzene ring of bisphenol in the case where the toner contains a bisphenol derivative such as bisphenol A. The toner having such peaks in an infrared absorption spectrum, for instance, does not contain a bisphenol derivative such as bisphenol A or contain a bisphenol derivative in an amount of 5 mol % or less relative to the whole alcohol component.

Figure 3:
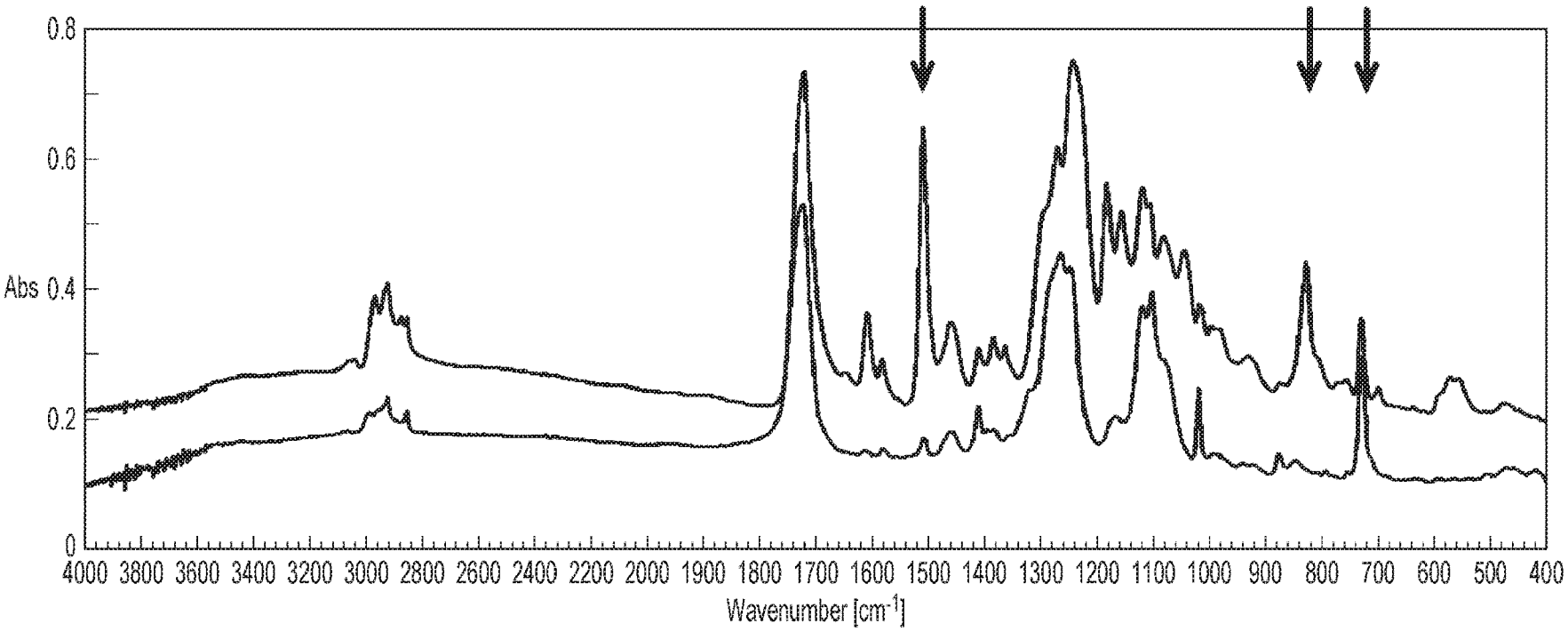
FIG. 3 is a chart illustrating an example of the IR spectrum of toner.

FIG. 3 is a chart illustrating an example of the IR spectrum of the toner. In FIG. 3, the IR spectrum of the toner used in the exemplary embodiment is the lower one, and the IR spectrum of a toner that is out of the scope of the exemplary embodiment is the upper one. In FIG. 3, the peak absorptions at wavenumbers of around 720 $cm^{-1}$, around 820 $cm^{-1}$, and around 1500 $cm^{-1}$ are denoted by the arrows.

The peaks around the individual wavenumbers (P1, P2, and P3) and the ratios of the peak absorption (P2/P1, P3/P1, and P2/P3) in the IR spectrum of the toner are adjusted by, for example, changing the amounts of aromatic dicarboxylic acid and aromatic diol each having an aromatic ring in the synthesis of the polyester resin used as the binder resin contained in the toner. In particular, in production of the toner having the above-mentioned specific ratios of the peak absorption according to the exemplary embodiment, the polyester resin used as the binder resin suitably does not contain a constitutional unit derived from an aromatic diol such as an ethylene oxide adduct of bisphenol A or a propylene oxide adduct of bisphenol A in terms of cracks of a fixed image.

In the case where the toner used in the exemplary embodiment is dissolved in toluene, an undissolved component (hereinafter also referred to as "toluene-insoluble component") is preferably from 28% to 38%, and more preferably from 30% to 35%. The toner having a toluene-insoluble component within such a range has a low humidity absorption property and is therefore less likely to suffer the coagulation and accumulation inside a toner cartridge in a high temperature and high humidity environment.

The toluene-insoluble component of the toner particles refers to the component that is contained in the toner particles but not dissolved in toluene. In other words, the toluene-insoluble component is an insoluble matter of which the principle component (for instance, 50 mass % or more of the whole) is a component of the binder resin that is not dissolved in toluene (particularly high-molecular-weight component of binder resin). The amount of the toluene-insoluble component can be an index of the cross-linked resin content in the toner.

The amount of the toluene-insoluble component is measured as follows. Toner particles (or toner) weighed to 1 g are put into weighed cylindrical filter paper made of glass fibers, and this cylindrical filter paper is attached to the extraction tube of a thermal Soxhlet extractor. Toluene is put into a flask and heated to 110° C. with a mantle heater. A heater attached to the extraction tube is used to heat the surrounding of the extraction tube to 125° C. The extraction is performed at such a reflux rate that a single cycle of extraction is in the range of four minutes to five minutes. After the extraction is performed for 10 hours, the cylindrical paper filter and residual toner are retrieved, dried, and weighed.

Then, the amount (mass %) of the toner particle residue (or toner residue) is calculated on the basis of the following equation and defined as the amount of the toluene-insoluble component (mass %).

amount (mass %) of toner particle residue (or toner residue)=[(weight of cylindrical filter paper+weight of residual toner) (g)−weight of cylindrical filter paper (g)]+mass (g) of toner particles (or toner)×100 Equation:

The toner particle residue (or toner residue) contains, for example, a colorant, an inorganic substance such as an external additive, and the high-molecular-weight component of the binder resin. In the case where the toner particles contain a release agent, the release agent is a toluene-soluble component because the extraction is carried out through heating.

The toluene-insoluble component of the toner particles is, for example, adjusted by (1) adding a cross-linking agent to a high-molecular-weight component having a reactive functional group at its end to form a cross-linked structure or a branched structure in the binder resin, (2) using a polyvalent metal ion in the binder resin to form a cross-linked structure or a branched structure in a high-molecular-weight component having an ionic functional group at its end, or (3) using, for instance, isocyanate in the binder resin to extend the chain structure of the resin or to allow it to branch.

The volume average particle size $D_{50v}$ of the toner used in the exemplary embodiment is, for example, suitably from 1 μm to 30 μm, and preferably from 3 μm to 20 μm. The volume average particle size $D_{50v}$ within such a range enables enhancements in adhesive force, developability, and the resolution of images. The volume average particle size $D_{50v}$ of the toner is defined as follows. Particle size distribution is measured with a measuring apparatus such as MULTISIZER II (manufactured by Beckman Coulter, Inc.), accumulative distribution by volume is drawn from the smaller diameter side in particle size ranges (channels) into which the measured particle size distribution is divided, and the particle size for an accumulative percentage of 50% is defined as the volume average particle size $D_{50v}$.

Developer

The developer used in the exemplary embodiment at least contains the above-mentioned toner. The developer may be a single component developer containing only the toner or may be a two-component toner that is the mixture of the toner and a carrier.

A carrier is not particularly limited, and any of known carriers can be used. Examples of the carrier include coated carriers in which the surface of a core formed of magnetic powder has been coated with a coating resin, magnetic powder dispersed carriers in which magnetic powder has been dispersed in or blended with a matrix resin, and resin impregnated carriers in which porous magnetic powder has been impregnated with resin. In the magnetic powder dispersed carriers and the resin impregnated carriers, the constituent particles may have a surface coated with a coating resin.

Examples of the magnetic powder include magnetic metals, such as iron oxide, nickel, and cobalt, and magnetic oxides such as ferrite and magnetite. Examples of conductive particles include particles of metals such as gold, silver, and copper; carbon black particles; titanium oxide particles; zinc oxide particles; tin oxide particles; barium sulfate particles; aluminum borate particles; and potassium titanate particles.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing an organosiloxane bond or a modified product thereof, fluororesins, polyester, polycarbonate, phenol resins, and epoxy resins. The coating resin and the matrix resin may contain other additives such as conductive materials.

An example of the preparation of the coated carrier involves coating with a coating layer forming solution in which the coating resin and optionally a variety of additives have been dissolved in a proper solvent. The solvent is not particularly limited and may be determined in view of, for instance, the type of coating resin to be used and coating suitability.

Specific examples of the coating method include a dipping method of dipping the core into the coating layer forming solution, a spray method of spraying the coating layer forming solution onto the surface of the core, a fluid-bed method of spraying the coating layer forming solution to the core that is in a state of being floated by the flowing air, and a kneader coating method of mixing the core of the carrier with the coating layer forming solution in the kneader coater and removing a solvent.

The mixing ratio (mass ratio) of the toner to the carrier in the two-component developer (toner:carrier) is preferably in the range of 1:100 to 30:100, and more preferably 3:100 to 20:100.

Figure 4:
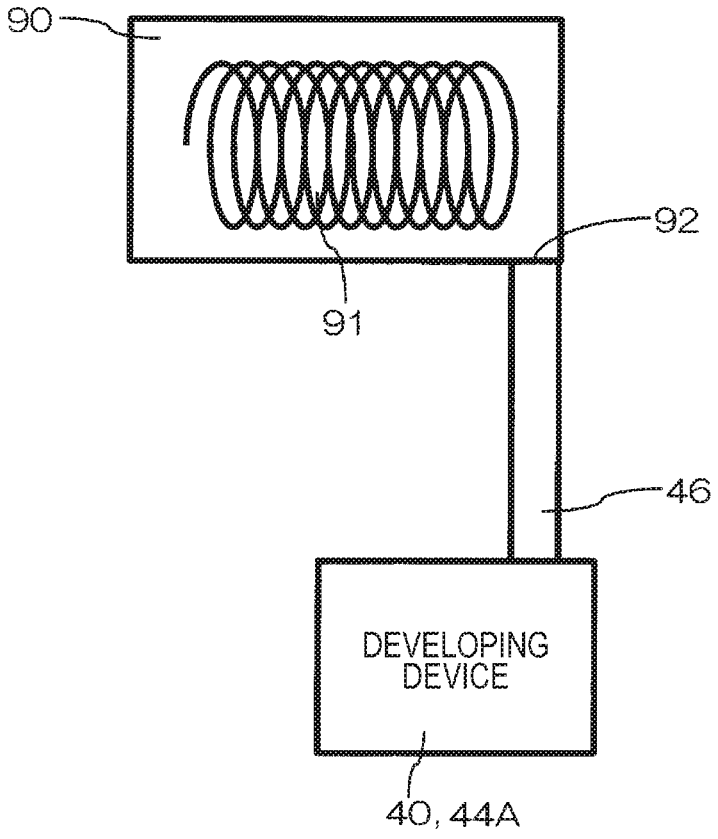
FIG. 4 RELATED ART
FIG. 4 schematically illustrates an example of the structure of a supplying device used in a related art.

The operation of the image forming apparatus 100 according to the exemplary embodiment will now be described. In the image forming apparatus 100, the toner used for developing an electrostatic latent image contains a polyester resin as the binder resin, the weight average molecular weight Mw of the THF-soluble component of the toner is from 25,000 to 60,000, the ratio Mw/Mn of the weight average molecular weight Mw to the number average molecular weight Mn is from 5 to 10, and the IR spectrum of the toner has peaks of which the peak heights fall within a specific ratio. Such a toner is excellent in fixability, while it has and high moisture absorption property and is likely to coagulate. FIG. 4 illustrates an example of a device used in a related art for accommodating and supplying toner. In a supplying device 90 illustrated in FIG. 4, toner is transported by being pushed to a discharge port 92 by the rotation of an agitator 91. In the supplying device 90 used in a related art, the mechanical contact of the agitator 91 with the toner in such a manner causes the toner to be pressured and compressed, and the toner coagulates and accumulates inside the supplying device 90. The supply rate of the toner per time greatly changes (varies), which causes a problem of a reduction in discharge stability; in particular, such a reduction in discharge stability occurs particularly in a high temperature and high humidity environment.

The image forming apparatus 100 according to the exemplary embodiment includes the supplying device 60 including the toner cartridge 61 having the bag 61A at least partially formed of a flexible material and deformed on the basis of a change in internal atmospheric pressure, the toner transport channel 63, the filter 64, and the suction pump 62 that is in communication with the toner cartridge 61 through the vent pipe 65 as described above. The supplying device 60 used in the exemplary embodiment can transport toner from the toner cartridge 61 owing to the suction pressure generated by the suction pump 62. A reduction in the internal pressure of the bag 61A leads to the deformation of the flexible material used for forming the bag 61A, and the internal volume of the bag 61A therefore decreases. These movement can promote the transport of the toner contained in the bag 61A to the toner discharge port 61B. Thus, in the image forming apparatus 100 according to the exemplary embodiment, even when the above-mentioned specific toner that has a high humidity absorption property and that is likely to coagulate is used, the retention of the toner inside the toner cartridge 61 is reduced, and a variation in the amount of the toner to be supplied to the developing device 40 is reduced, and the discharge stability of the toner can be therefore enhanced as compared with the supplying device of a related art in which the toner is transported with the unit that mechanically contacts with the toner, such as the agitator 91. The transport of the toner inside the bag 61A to the toner discharge port 61B is promoted to reduce the retention of the toner, and the amount of an unused residual toner therefore becomes small when the toner cartridge 61 is exchanged, so that the bag 61A can contain a reduced amount of the toner when the toner cartridge 61 is shipped.

In the above description, the supplying device 60 supplies a supplemental toner to the developing device 40; however, the supplying device used in the exemplary embodiment may supply a two-component developer, which is the mixture of the toner and the carrier, to the developing device 40.

EXAMPLES

The image forming apparatus according to the exemplary embodiment will now be specifically described with reference to Examples but is not limited thereto. The terms "part" and "%" in the following description are on a mass basis unless otherwise specified.

Measurements

The weight average molecular weight Mw and number average molecular weight Mn of the THF-soluble components of resins and toners are, for instance, determined by gel permeation chromatography (GPC). The THF-soluble component of the toner is analyzed as follows: 0.5 mg of a produced toner is dissolved into 1 g of THF, the solution is subjected to ultrasonic dispersion, the concentration of the toner is adjusted to be 0.5%, and then the dissolved component thereof is analyzed by GPC. The determination of the molecular weights by GPC involves using a measurement apparatus that is GPC•HLC-8120GPC manufactured by Tosoh Corporation, a column that is TSKgel SuperHM-M (6.0 mm ID×15 cm) manufactured by Tosoh Corporation, and THF as an eluent. From results of the GPC, the weight average molecular weight Mw and the number average molecular weight Mn are calculated from a molecular weight calibration curve plotted on the basis of a standard sample of monodisperse polystyrene.

The IR spectrum of the toner is determined as follows: 40 mg of KBr powder and 0.2 mg of a produced toner (concentration of 0.5%) are well pulverized and mixed with each other with a mortar, the resulting product is pressure-molded into a sample, and then the sample is analyzed with Fourier transform infrared spectrometer (FTIR-410 manufactured by JASCO Corporation). From the obtained IR spectrum chart, the peak absorptions around a wavenumber of 720 $cm^{-1}$ (P1), around a wavenumber of 820 $cm^{-1}$ (P2), and around a wavenumber of 1500 $cm^{-1}$ (P3) are calculated by the above-mentioned process.

In order to determine the toluene-insoluble component of toner, the toner is put into toluene, the weight of the undissolved residual component is measured, and the mass ratio of the undissolved residual component to the initial toner is calculated. The volume average particle size $D_{50v}$ of the toner is measured with MULTISIZER II (manufactured by Beckman Coulter, Inc.).

Production of Amorphous Polyester Resin (A1)

Into a three-neck flask of which the inside has been dried, 60 parts of dimethyl terephthalate, 74 parts of dimethyl fumarate, 30 parts of dodecenylsuccinic anhydride, 22 parts of trimellitic acid, 138 parts of propylene glycol, and 0.3 parts of dibutyltin oxide are put. The temperature is increased under stirring in a nitrogen atmosphere, and the mixture is reacted at 185° C. for 3 hours while removing water generated during the reaction to the outside. Then, the temperature is increased up to 240° C. while the pressure is gradually reduced, and the resulting product is further reacted for 4 hours and then cooled. Through this process, an amorphous polyester resin (A1) having a weight average molecular weight Mw of 39,000 is produced.

Production of Amorphous Polyester Resin (A2)

An amorphous polyester resin (A2) is produced in the same manner as in the production of the amorphous polyester resin (A1) except for the following changes: the reaction is performed at 190° C. for 3 hours, the temperature is subsequently increased up to 220° C. while the pressure is gradually reduced, and the resulting product is further reacted for 2.5 hours. The weight average molecular weight Mw of the amorphous polyester resin (A2) is 26,000.

Production of Amorphous Polyester Resin (A3)

An amorphous polyester resin (A3) is produced in the same manner as in the production of the amorphous polyester resin (A1) except for the following changes: 138 parts of the propylene glycol is changed to 128 parts of propylene glycol and 19 parts of butylene glycol, the reaction is performed at 195° C. for 4 hours, the temperature is subsequently increased up to 240° C. while the pressure is gradually reduced, and the resulting product is further reacted for 6 hours. The weight average molecular weight Mw of the amorphous polyester resin (A3) is 56,000.

Production of Crystalline Polyester Resin (B1)

Into a three-neck flask of which the inside has been dried, 100 parts of dimethyl sebacate, 67.8 parts of hexanediol, and 0.10 parts of dibutyltin oxide are put. The temperature is increased under stirring in a nitrogen atmosphere, and the mixture is reacted at 185° C. for 5 hours while removing water generated during the reaction to the outside. Then, the temperature is increased up to 220° C. while the pressure is gradually reduced, and the resulting product is further reacted for 6 hours and then cooled. Through this process, a crystalline polyester resin (B1) having a weight average molecular weight of 33,700 is produced.

The melting temperature of the crystalline polyester resin (B1) is determined from a DSC curve obtained by differential scanning calorimetry (DSC) in accordance with "Melting Peak Temperature" described in determination of melting temperature in JIS K 7121-1987 "Testing Methods for Transition Temperatures of Plastics". The measurement shows that the melting temperature is 71° C.

Production of Amorphous Polyester Resin (A4)

An amorphous polyester resin (A4) is produced in the same manner as in the production of the amorphous polyester resin (A1) except that the composition of the components are changed to 60 parts of dimethyl terephthalate, 74 parts of dimethyl fumarate, 30 parts of dodecenylsuccinic anhydride, 22 parts of trimellitic acid, 137 parts of an ethylene oxide adduct of bisphenol A, 191 parts of a propylene oxide adduct of bisphenol A, and 0.3 parts of dibutyltin oxide. The weight average molecular weight Mw of the amorphous polyester resin (A4) is 27,000.

Production of Toner (1)

Into a HENSCHEL MIXER (manufactured by NIPPON COKE & ENGINEERING CO., LTD.), 73 parts of the amorphous polyester resin (A1), 6 parts of the crystalline polyester resin (B1), 7 parts of a colorant (C.I. Pigment Red 122), 5 parts of paraffin wax (manufactured by NIPPON SEIRO CO., LTD., melting temperature of 73° C.) as a release agent, and 2 parts of ester wax (behenyl behenate, UNISTER M-2222SL manufactured by NOF CORPORATION) are put. The mixture is stirred and mixed at a rotational speed of 15 m/s for 5 minutes, and the resulting mixture is melt-kneaded with an extruder-type continuous kneader. In the extruder-type continuous kneader, the temperature is 160° C. on the supply side and 130° C. on the discharge side, the temperature of a cooling roller is 40° C. on the supply side and 25° C. on the discharge side. The temperature of a cooling belt is adjusted to be 10° C.

The melt-kneaded product is cooled, then roughly pulverized with a hammer mill, and subsequently finely pulverized with a jet-type pulverizer (manufactured by Nippon Pneumatic Mfg. Co., Ltd.) to a volume average particle size of 6.5 μm. The resulting product is classified with an elbow-jet classifier (type: EJ-LABO, manufactured by Nittetsu Mining Co., Ltd.) to remove fine powder and coarse powder, thereby yielding toner (1). The toner (1) has a volume average particle size of 7.0 μm.

The tetrahydrofuran-soluble component of the toner (1) is analyzed by GPC; the weight average molecular weight Mw is 37,000, and the number average molecular weight Mn is 5,000. Thus, Mw/Mn is 7.4. From the IR spectrum of the toner (1), the ratio (P3/P1) of the peak absorption around a wavenumber of 1500 $cm^{-1}$ (P3) to the peak absorption around a wavenumber of 720 $cm^{-1}$ (P1), the ratio (P2/P1) of the peak absorption around a wavenumber of 820 $cm^{-1}$ (P2) to the peak absorption around a wavenumber of 720 $cm^{-1}$ (P1), and the ratio (P2/P3) of the peak absorption around a wavenumber of 8200 $cm^{-1}$ (P2) to the peak absorption around a wavenumber of 1500 $cm^{-1}$ (P3) are calculated; the ratio (P3/P1) is 0.5, the ratio (P2/P1) is 0.1, and the ratio (P2/P3) is 0.3. The toluene-insoluble component of the toner (1) is 34 mass %.

Production of Toner (2)

A toner (2) is produced in the same manner as in the production of the toner (1) except that the amorphous polyester resin (A2) is used in place of the amorphous polyester resin (A1). The toner (2) has a volume average particle size of 6.8 μm. The weight average molecular weight Mw of the toner (2) is 25,000, the number average molecular weight Mn is 3,000, and Mw/Mn is 8.3. In the toner (2), the ratio (P3/P1) is 0.6, the ratio (P2/P1) is 0.2, and the ratio (P2/P3) is 0.3. The toluene-insoluble component of the toner (2) is 28 mass %.

Production of Toner (3)

A toner (3) is produced in the same manner as in the production of the toner (1) except that the amorphous polyester resin (A3) is used in place of the amorphous polyester resin (A1). The toner (3) has a volume average particle size of 7.5 μm. The weight average molecular weight Mw of the toner (3) is 60,000, the number average molecular weight Mn is 8,500, the peak molecular weight is 11,000, and Mw/Mn is 7.1. In the toner (3), the ratio (P3/P1) is 0.5, the ratio (P2/P1) is 0.2, and the ratio (P2/P3) is 0.4. The toluene-insoluble component of the toner (3) is 38 mass %.

Production of Toner (4)

A toner (4) is produced in the same manner as in the production of the toner (1) except that the crystalline resin is not used and that the amount of the amorphous polyester resin (A1) is changed to 79 parts. The toner (4) has a volume average particle size of 7.1 μm. The weight average molecular weight Mw of the toner (4) is 39,000, the number average molecular weight Mn is 4,500, the peak molecular weight is 9,800, and Mw/Mn is 8.7. In the toner (4), the ratio (P3/P1) is 0.6, the ratio (P2/P1) is 0.1, and the ratio (P2/P3) is 0.3. The toluene-insoluble component of the toner (4) is 33 mass %.

Production of Toner (5)

A toner (5) is produced in the same manner as in the production of the toner (4) except that the amorphous polyester resin (A4) is used in place of the amorphous polyester resin (A1). The toner (5) has a volume average particle size of 7.7 μm. The weight average molecular weight Mw of the toner (5) is 27,000, the number average molecular weight Mn is 5,000, the peak molecular weight is 7,500, and Mw/Mn is 5.4. In the toner (5), the ratio (P3/P1) is 3.0, the ratio (P2/P1) is 1.7, and the ratio (P2/P3) is 0.6. The toluene-insoluble component of the toner (5) is 31 mass %.

Production of Carrier

In order to produce a carrier, 14 parts of toluene and 2 parts of a styrene-methyl methacrylate copolymer (component ratio: styrene/methyl methacrylate=90/10, weight average molecular weight Mw: 80,000) are stirred for 10 minutes with a stirrer to prepare a coating liquid in which these materials have been dispersed. The coating liquid and 100 parts of ferrite particles (volume average particle size: 50 μm) are put into a vacuum degassing kneader (manufactured by INOUE MFG., INC.) and stirred at 60° C. for 30 minutes. Then, the pressure is reduced under heating for degassing, and the resulting product is dried and then sifted with a sieve having a mesh size of 105 μm to yield the carrier.

Production of Developer

In a 2-liter V blender, 8 parts of the individual toners (1) to (5) are separately mixed with 100 parts of the carrier for 20 minutes. Then, the mixtures are sifted with a sieve having a mesh size of 212 μm to produce developers (1) to (5).

Example 1

Toner Supply Test

The supplying device 60 illustrated in FIG. 2 and having the toner cartridge 61 and the suction pump 62 is used as the supplying device used in the exemplary embodiment to carry out a toner supply test. The toner cartridge 61 has the bag 61A formed of a polyolefin resin, and the bag 61A has a thickness of 200 μm and a volume of 1500 mL. Into the bag 61A, 500 g of the toner (1) is put. The bag 61A is connected to the toner transport channel 63 through the toner discharge port 61B. The suction pump 62 is used, and its suction port is connected to the vent pipe 65 of the supplying device 60. The filter 64 for separating the toner transport channel 63 from the vent pipe 65 is a glass microfiber filter ("1821-025" manufactured by Whatman plc).

The supplying device 60 is operated in a high temperature and high humidity environment of a temperature of 28° C. and relative humidity of 85%, and the supply rate of the toner is set to be 640 mg/s; in this state, the amount of the toner (1) discharged from the supplying device 60 is measured. A standard deviation σ is determined on the basis of discharge amounts in discharge of 100 g, 200 g, 300 g, and 400 g of the toner (1) to analyze a variation in the supply rate of the toner, and the discharge stability of the toner is evaluated. The result shows that the supply rate of the toner is 662 mg/s and that the standard deviation σ is 48 mg/s. The pressure sensor 66 is used to measure atmospheric pressure in the toner discharge port 61B and the toner transport channel 63 in the supply of the toner, and the result of the measurement shows that the atmospheric pressure is 0.31 mPa.

Fixability Test

The supplying device 60 used in the toner supply test is attached to DocuPrint700 manufactured by Fuji Xerox Co., Ltd, and this modified machine is used as the image forming apparatus according to the exemplary embodiment to form a test image to evaluate the fixability of the image. The developer (1) is put into the developing device of the image forming apparatus, and the toner (1) is put into the toner cartridge 61 of the supplying device 60. An image of 100% solid patch is formed on 10 sheets of recording paper in a high temperature and high humidity environment of a temperature of 28° C. and relative humidity of 85% at a fixing temperature of 180° C. and a process speed of 220 mm/s.

The output image formed on the tenth paper is visually observed, and the fixability of the toner (1) to the paper is evaluated on the basis of the following criteria.

Evaluation Criteria for Fixability

A: No peel-off of toner from patch and no re-fixation to white part of paper are observed B: Peel-off of toner from patch and re-fixation to white part of paper are observed

Examples 2 to 4

Except that the toners (2) to (4) are individually used in place of the toner (1), the toner supply test is carried out as in Example 1. Except that the toners (2) to (4) are individually used in place of the toner (1) and that the developers (2) to (4) are individually used instead of the developer (1), the fixability test is carried out as in Example 1. Table 1 shows results of the toner supply test and fixability test in Examples 2 to 4.

Example 5

Except that the supply rate of the toner is set to be 320 mg/s, the toner supply test and the fixability test are carried out as in Example 1. Results of the tests show that the supply rate of the toner is 320 mg/s and that the standard deviation σ is 21 mg/s. The atmospheric pressure in the toner discharge port 61B and the toner transport channel 63 is measured and found to be 0.21 mPa. Table 1 shows results of the toner supply test and fixability test in Example 5.

Reference Example 1

Except that the toner (5) is used in place of the toner (1), the toner supply test is carried out as in Example 1. Except that the toner (5) is used in place of the toner (1) and that the developer (5) is used instead of the developer (1), the fixability test is carried out as in Example 1. The result of the toner supply test shows that the supply rate of the toner is 658 mg/s and that the standard deviation σ is 51 mg/s. The atmospheric pressure in the toner discharge port 61B and the toner transport channel 63 is measured and found to be 0.29 mPa. Result of the fixability test is evaluated as "B".

Comparative Example 1

Except that the supplying device 60 used in the exemplary embodiment is changed to the supplying device 90 illustrated in FIG. 4, the toner supply test and the fixability test are carried out as in Example 1. In the supplying device 90 used in Comparative Example 1, the rotation of the agitator 91 causes the toner to be transported to the discharge port 92, and then the toner is transported from the discharge port 92 to the developing device 40 owing to gravity. The agitator 91 has a cylinder having a diameter of 25 mm and a streak of blade formed on the circumference of the cylinder. The width of the blade is 5 mm, and the pitch width of the blade in the direction of the rotational shaft is 20 mm. In the toner supply test in Comparative Example 1, 500 g of the toner (1) is put into the supplying device 90, and the supply rate of the toner is set to be 640 mg/s; in this state, the amount of the discharged toner (1) is measured in a high temperature and high humidity environment of a temperature of 28° C. and relative humidity of 85%. Result of the measurement shows that the supply rate of the toner is 648 mg/s and that the standard deviation σ is 122 mg/s. The supplying device 90 is attached to DOCUPRINT700 manufactured by Fuji Xerox Co., Ltd., and this modified machine is used as the image forming apparatus to form a test image to carry out the fixability test as in Example 1. The fixability of the toner (1) to paper is evaluated as "A".

Table 1 shows results in Examples, Reference Example 1, and Comparative Example 1.

TABLE 1

| | Developer | | | | | | | | | | |
|---|---|---|---|---|---|---|---|---|---|---|---|
| | | | Molecular weights of THF-soluble component | | | IR spectrum characteristics of toner particles | | | | | |
| | Toner | Binder resin | Mw | Mn | Mw/Mn | Peak absorption P3 at 1500 $cm^{-1}$ | Peak absorption P2 at 820 $cm^{-1}$ | Peak absorption P1 at 720 $cm^{-1}$ | P3/P1 | P2/P1 | P2/P3 |
| Example 1 | (1) | (A1) + (B1) | 37000 | 5000 | 7.4 | 0.07 | 0.02 | 0.15 | 0.5 | 0.1 | 0.3 |
| Example 2 | (2) | (A2) + (B1) | 25000 | 3000 | 8.3 | 0.12 | 0.04 | 0.20 | 0.6 | 0.2 | 0.3 |
| Example 3 | (3) | (A3) + (B1) | 60000 | 8500 | 7.1 | 0.05 | 0.02 | 0.11 | 0.5 | 0.2 | 0.4 |
| Example 4 | (4) | (A1) | 39000 | 4500 | 8.7 | 0.08 | 0.02 | 0.14 | 0.6 | 0.1 | 0.3 |
| Example 5 | (1) | (A1) + (B1) | 37000 | 5000 | 7.4 | 0.07 | 0.02 | 0.15 | 0.5 | 0.1 | 0.3 |
| Comparative Example 1 | (1) | (A1) + (B1) | 37000 | 5000 | 7.4 | 0.07 | 0.02 | 0.15 | 0.5 | 0.1 | 0.3 |
| Reference Example 1 | (5) | (A4) | 27000 | 5000 | 5.4 | 0.90 | 0.50 | 0.30 | 3.0 | 1.7 | 0.6 |

| | Developer Toluene-insoluble component (mass %) | Evaluation Tests: Toner supply test: Toner supply rate (mg/s) | Toner supply test: Standard deviation σ (mg/s) | Fixability test | Atmospheric pressure (mPa) |
|---|---|---|---|---|---|
| Example 1 | 34 | 662 | 48 | A | 0.31 |
| Example 2 | 28 | 671 | 50 | A | 0.30 |
| Example 3 | 38 | 650 | 49 | A | 0.33 |
| Example 4 | 33 | 645 | 51 | A | 0.29 |
| Example 5 | 34 | 320 | 21 | A | 0.21 |

TABLE 1-continued

| | | | | | |
|---|---|---|---|---|---|
| Comparative Example 1 | 34 | 648 | 122 | A | — |
| Reference Example 1 | 31 | 658 | 51 | B | 0.29 |

As is clear from the results shown in Table 1, even when a toner having a high humidity absorption property and being likely to coagulate is used in a high temperature and high humidity environment, use of the supplying device 60 used in the exemplary embodiment and having the toner cartridge 61 and the suction pump 62 enables a great reduction in a variation in the supply rate of the toner and an enhancement in the discharge stability of the toner as compared with use of the supplying device 90 having a unit that mechanically contacts with the toner to transport the toner, such as the agitator 91.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holder;

a developing device configured to contain an electrostatic charge image developer and configured to develop an electrostatic charge image on a surface of the image holder with the electrostatic charge image developer to form a toner image; and a supplying device including a storage and a transport unit, wherein the storage is configured to store toner, wherein the storage includes a bag having a flexible material, wherein the transport unit is configured to use suction pressure to transport the toner from the storage, wherein the transport unit is configured to supply the toner to the developing device, wherein the electrostatic charge image developer contains the toner, wherein the toner contains an amorphous polyester resin as a binder resin, wherein and toner particles of the toner have a weight average molecular weight Mw and a number average molecular weight Mn, wherein the weight average molecular weight Mw is in a range of 25,000 to 60,000, wherein a ratio Mw/Mn is in a range of 5 to 10, wherein a ratio (P2/P1) of a peak height of an absorption peak of the toner particles at a wavenumber of 820 $cm^{-1}$ (P2) to a peak height of the absorption peak at a wavenumber of 720 $cm^{-1}$ (P1) is 0.4 or less, and wherein a ratio (P3/P1) of a peak height of the absorption peak of the toner particles at a wavenumber of 1500 $cm^{-1}$ (P3) to the peak height of the absorption peak at the wavenumber of 720 $cm^{-1}$ (P1) is 0.6 or less.

2. The image forming apparatus according to claim 1, wherein the ratio (P2/P1) of the peak height of the absorption peak of the toner particles at the wavenumber of 820 $cm^{-1}$ (P2) to the peak height of the absorption peak at the wavenumber of 720 $cm^{-1}$ (P1) is 0.3 or less.

3. The image forming apparatus according to claim 1, wherein the ratio (P3/P1) of the peak height of the absorption peak of the toner particles at the wavenumber of 1500 $cm^{-1}$ (P3) to the peak height of the absorption peak at the wavenumber of 720 $cm^{-1}$ (P1) is 0.5 or less.

4. The image forming apparatus according to claim 1, wherein a toluene-insoluble component of the toner is in a range of 28 mass % to 38 mass %.

5. The image forming apparatus according to claim 1, wherein a ratio (P2/P3) of the peak height of the absorption peak of the toner particles at the wavenumber of 820 $cm^{-1}$ (P2) to the peak height of the absorption peak at the wavenumber of 1500 $cm^{-1}$ (P3) is 0.5 or less.

6. The image forming apparatus according to claim 1, wherein the toner particles contain a crystalline resin.

7. The image forming apparatus according to claim 6, wherein an amount of the crystalline resin is in a range of 3 mass % to 20 mass % relative to a whole amount of the toner.

8. The image forming apparatus according to claim 1, wherein the bag is formed of a polymeric material.

9. The image forming apparatus according to claim 8, wherein the bag is formed of polyolefin.

10. The image forming apparatus according to claim 1, wherein a thickness of the bag is in a range of 0.03 mm to 1.0 mm.

11. The image forming apparatus according to claim 1, wherein pressure in a discharge port through which the toner can be discharged from the bag is in a range from 0.1 mPa to 0.5 mPa.

* * * * *